US008291612B2

(12) United States Patent
Ferguson

(10) Patent No.: US 8,291,612 B2
(45) **Date of Patent: *Oct. 23, 2012**

(54) HEATER ELEMENT FOR THE INNER SOLE OF A FOOTWEAR

(75) Inventor: Patrick Ferguson, North Shields (GB)

(73) Assignee: NEL Technologies Limited, Westway Industrial Park, Throckley Newcastle upon Tyne (GB)

( * ) Notice: Subject to any disclaimer, the term of this patent is extended or adjusted under 35 U.S.C. 154(b) by 1412 days.

This patent is subject to a terminal disclaimer.

(21) Appl. No.: 10/558,845

(22) PCT Filed: Jun. 2, 2004

(86) PCT No.: PCT/GB2004/002358

§ 371 (c)(1),
(2), (4) Date: Aug. 21, 2006

(87) PCT Pub. No.: WO2004/107817

PCT Pub. Date: Dec. 9, 2004

(65) Prior Publication Data

US 2007/0089318 A1 Apr. 26, 2007

(30) Foreign Application Priority Data

Jun. 2, 2003 (GB) ..... 0312550.7

(51) Int. Cl.
*A43B 7/02* (2006.01)
*A43B 13/38* (2006.01)

(52) U.S. Cl. ..... 36/2.6; 36/44; 219/211

(58) Field of Classification Search ..... 36/2.6, 36/43, 44, 71; 219/211

See application file for complete search history.

(56) References Cited

U.S. PATENT DOCUMENTS 2,717,949 A 9/1955 Challenner
3,296,415 A 1/1967 Eisler
3,660,088 A 5/1972 Lundsager (Continued)

FOREIGN PATENT DOCUMENTS

DE 3210097 9/1983

(Continued)

OTHER PUBLICATIONS

Adeyeye, C. M. and Price, J. C., "Development and Evaluation of Sustained Release Ibuprofen-Wax Microspheres: I. Effect of Formulation Variables on Physical Characteristics", Pharmaceutical Research, vol. 8, No. 11, pp. 1377-1383 (1991).

(Continued)

*Primary Examiner* — Khoa Huynh
*Assistant Examiner* — Sharon M Prange
(74) *Attorney, Agent, or Firm* — Barlow, Josephs & Holmes, Ltd.

(57) ABSTRACT

Disclosed is a breathable insole heater element (12, 40) for footwear. The heater element is formed by photochemically etching a porous metallized fabric, e.g. nickel-metallized polyester woven fabric. The heater element is embedded in or laminated in an insole for an article of footwear such as a shoe or boot. The insole may be cut to size as desired. The insole may include microencapsulated agents such as fragrances, perfumes, microbials or insect repellents. The microcapsules may be activated to release the agents due to the heat generated by the heater element in operation.

21 Claims, 2 Drawing Sheets

U.S. PATENT DOCUMENTS

| | | | | |
|---|---|---|---|---|
| 3,767,398 | A | 10/1973 | Morgan | |
| 3,946,193 | A * | 3/1976 | Giese | 219/211 |
| 4,103,102 | A * | 7/1978 | Klein | 174/254 |
| 4,201,825 | A | 5/1980 | Ebneth | |
| 4,257,176 | A | 3/1981 | Hartung et al. | |
| 4,508,776 | A * | 4/1985 | Smith | 442/230 |
| 4,565,745 | A | 1/1986 | Kaminskas | |
| 4,665,301 | A * | 5/1987 | Bondy | 219/211 |
| 4,674,199 | A * | 6/1987 | Lakic | 36/2.6 |
| 4,743,740 | A | 5/1988 | Adee | |
| 4,764,665 | A * | 8/1988 | Orban et al. | 219/549 |
| 4,798,933 | A | 1/1989 | Annovi | |
| 4,910,881 | A * | 3/1990 | Baggio et al. | 36/2.6 |
| 4,948,951 | A | 8/1990 | Balzano | |
| 5,041,717 | A | 8/1991 | Shay, III et al. | |
| 5,352,862 | A | 10/1994 | Barr | |
| 5,534,021 | A | 7/1996 | Dvoretzky et al. | |
| 5,580,573 | A | 12/1996 | Kydonieus et al. | |
| 5,648,003 | A | 7/1997 | Liang et al. | |
| 5,829,171 | A | 11/1998 | Weber et al. | |
| 5,932,496 | A * | 8/1999 | Morris et al. | 442/238 |
| 6,143,211 | A * | 11/2000 | Mathiowitz et al. | 264/4 |
| 6,172,344 | B1 | 1/2001 | Gordon et al. | |
| 6,227,458 | B1 | 5/2001 | Dever et al. | |
| 6,229,123 | B1 | 5/2001 | Kochman et al. | |
| 6,294,313 | B1 | 9/2001 | Kobayashi et al. | |
| 6,309,986 | B1 | 10/2001 | Flashinski et al. | |
| 6,423,018 | B1 | 7/2002 | Augustine | |
| 6,436,063 | B1 | 8/2002 | tAugustine et al. | |
| 6,501,055 | B2 | 12/2002 | Rock et al. | |
| 6,551,560 | B1 | 4/2003 | Flashinski et al. | |
| 6,613,350 | B1 | 9/2003 | Zhang et al. | |
| 7,115,844 | B2 | 10/2006 | Ferguson | |
| 7,777,156 | B2 * | 8/2010 | Rock et al. | 219/212 |
| 2001/0002669 | A1 | 6/2001 | Kochman et al. | |
| 2002/0133973 | A1 * | 9/2002 | Lin | 36/2.6 |
| 2003/0124167 | A1 | 7/2003 | Thies | |
| 2007/0187392 | A1 | 8/2007 | Ferguson | |
| 2007/0210051 | A1 | 9/2007 | Ferguson | |

FOREIGN PATENT DOCUMENTS

| | | | |
|---|---|---|---|
| GB | 2092868 | A | 8/1982 |
| GB | 2175849 | A | 12/1986 |
| GB | 2205496 | A | 12/1988 |
| GB | 2336514 | A | 10/1999 |
| GB | 2383197 | A | 6/2003 |
| JP | 60047686 | A | 3/1986 |
| JP | 03037021 | | 2/1991 |
| JP | 04002079 | | 1/1992 |
| WO | 8810058 | A1 | 12/1988 |
| WO | 0101855 | A1 | 1/2001 |
| WO | 0124580 | A1 | 4/2001 |
| WO | 03039417 | A2 | 5/2003 |
| WO | 03053101 | A1 | 6/2003 |
| WO | 2004107817 | A1 | 12/2004 |

OTHER PUBLICATIONS

Adeyeye, C. M. and Price, J. C., "Development and Evaluation of Sustained Release Ibuprofen-Wax Microspheres: II. In vitro Dissolution Studies", Pharmaceutical Research vol. 11, No. 4, pp. 575-579 (1994).

Adeyeye, C. M. and Price, J. C., "Chemical, dissolution stability and microscopic evaluation of suspensions of ibuprofen-wax microspheres", Journal of Microencapsulation, vol. 14, pp. 357-377 (1997).

US 6,290,977, 09/2001, Friars et al. (withdrawn)

* cited by examiner

HEATER ELEMENT FOR THE INNER SOLE OF A FOOTWEAR

BACKGROUND TO THE INVENTION

1. Field of the Invention

The present invention relates to an insole heater element and/or to an insole incorporating such an element for footwear. For example, the invention relates to a breathable porous flexible insole heater and optionally to an associated functional chemical delivery system for footwear.

2. Related Art

The design and utilisation of heater systems for footwear, particularly for ski-boot applications are known. See, for example, U.S. Pat. Nos. 5,041,717 and 4,798,933. These documents teach the use of a rigid electrical heating element embedded or otherwise fixed into a removable shoe insole unit, which can be cut to size as desired. An electrical connection to a battery is also provided, designed to be carried by the user.

Known heater elements for such applications are limited by: their comparatively high manufacturing complexity and hence cost; their thickness and rigidity; their lack of breathability to accommodate the microclimate conditions of footwear; the restricted area over which heating is applied and their limited design potential (in terms of aesthetics and capacity to be personalised). A further limitation of known insole heaters is the cumbersome design of the electrical connection, which can sometimes be felt by the wearer as it passes beneath the main body of the insole when in use. This is at least one reason why known heater insoles have high thickness.

SUMMARY OF THE INVENTION

The present inventor has realised that known insoles suffer from the drawbacks and limitations set out above. Accordingly, the present invention has been made in order to address these drawbacks and limitations, and preferably to reduce, ameliorate or even overcome them.

Preferably, the present invention provides a breathable, cost-effective (and therefore optionally disposable), thin, flexible fabric heater element, which is fully integrated with the insole unit and is capable of being washed and reused as required.

Accordingly, the present invention provides a heatable insole for footwear having a heater element formed from flexible, porous metallised fabric.

Typically, the heater element is formed by photochemical etching of metallised fabric.

In a preferred embodiment, the invention comprises a flexible, porous metallised fabric heater element which is integrated within the construction of an insole for use in a wide variety of footwear applications (e.g. sports footwear, work and protection footwear, outdoor and leisure footwear). This wide variety of proposed uses is made possible by the shape of the new insole heater, which can be made thin, conformable and can incorporate heater elements of different sizes and specifications. In contrast to known heatable insoles, an insole of the present invention can also be made washable (without removing the heater element) and may be reused. Alternatively, the unit may be disposable because of its low manufacturing cost. A surface of the insole may also be printed to decorate or otherwise personalise its appearance by techniques such as thermostatic printing (Registered Trade Mark), dye sublimation or ink jet printing.

Typically, the heater is composed of a thin, porous, etched metallised fabric element. Preferably, the track pattern of the heater circuit can be formed in a desired configuration during manufacture so that, during the use of the heater circuit, heating performance is regulated to provide uniform or differential heating to the foot. This differential heating may be achieved using a constant electrical energy input. This is advantageous where heat needs to be delivered preferentially to particular parts of the foot (e.g. the toe area) without constant adjustment of the input energy or use of multiple individual heaters.

Temperature control of the heater may be achieved by limiting the resistance of the element and/or by incorporating a thermal protection device in the element e.g. a surface mounted thermistor chip, in combination with a suitable control device.

Details of the construction, manufacture and heating performance of a suitable flexible, porous etched metallised fabric heater are described in WO03/053101, the content of which is incorporated by reference in its entirety. WO03/053101 claims priority from UK Patent Application No. 0228999.9, filed 14 Dec. 2001.

Preferably, the heater element has termination pads. These are at the end of the etched track and allow connection of the heater element to a battery/control system, which may be stored in the footwear (e.g. shoe) itself (e.g. in the heel cavity) or elsewhere.

Preferably, an electrical interconnect between the battery/control system and the heater element is not located under the footprint of the foot of the wearer as otherwise this may cause discomfort to the wearer. Rather, it is preferred that the electrical interconnect between the heater element termination pads and the battery/control system are provided at one end, e.g. the rear of the insole, at the back of the foot and heel. Examples of preferred interconnect solutions include, but are not limited to, suitable flexible substrate connection devices which utilise the flex-tail created from the etched metallised fabric. However, it will be understood that other termination positions and interconnection techniques are possible depending on the particular design of the insole and other performance requirements.

The porous fabric heater element may be incorporated into an insole using known methods of insole manufacture. Typically, the heater element (formed of breathable fabric) is laminated between a layer of insole face fabric (which may usually be composed of nonwoven, knitted or woven fabrics) and a backing layer, for example a foam backing. Other fabrics may be used in the composition of the insole depending on the design and the heater element may be placed between any of these layers as required.

The heater element may be laminated to the face fabric using a thermoplastic web material. Such materials are typically fibrous and have a high degree of open porosity. Typical thermoplastic webs soften when heated (e.g. to around 130° C.). Pressure may be applied to speed up the softening of the material. Typically, the thermoplastic web material is located between the heater element and the face fabric. This combination is then heated and pressed, so that the thermoplastic web is softened and deformed so as to adhere the heater element to the face fabric to form a laminate.

As will be clear, a backing fabric layer may be applied to the heater element in the same way as the face fabric layer.

Additionally or alternatively, the heater element may be integrated within other insole constructions including injection-moulded, compression-moulded, pre-moulded or shaped structures composed of for example, foams, thermoformed or metal substrates. Lamination may be achieved using known manufacturing methods. For example, thermal lamination may be carried out using meltblown thermoplastic webs, grids, nets, powders or polymeric coatings followed by compression to affect thermal adhesion of the different insole layers. Alternatively, other adhesives known in the art of shoe component manufacture can be used. The resulting insole heater can be formed thin and flexible. Typically, the insole thickness containing the heater element is in the range 0.1 mm to 1.0 mm thick but can be thicker if required using the appropriate insole materials.

Using a heater element according to an embodiment of the invention, an insole may be formed that has a heater element that is thin, flexible and porous. The heater element may be incorporated in to the insole so that it runs the full length of the insole rather than being positioned at one end only or at both the extremities. In that case, the heater needs to be able to repeatedly bend and deform in use, which is permitted by the flexibility of the heater element. The presence of the element along the length of the insole also allows differential heating of the shoe to be achieved by changing the heater element track resistance characteristics along the insole during manufacture. Therefore, for a constant electrical input, the heating capacity along the insole can be varied by appropriately varying the heater element pattern applied to the metallised fabric during manufacture.

The present inventor has realised that the present invention may have a further advantage over known insoles. It is preferred to incorporate functional chemicals into an insole according to an embodiment of the invention or into a shoe for use with the insole, said functional chemicals being ones that are capable of being initiated by operation of the heater element.

Preferably, the invention provides an insole as set out above and/or an article of footwear having heat-activatable agents for release due to heat generated by the heater element.

The chemicals (or agents) of interest include antimicrobials (for suppressing or killing microbiological activity, e.g. bacteria), insect repellants (for repelling insects such as mosquitoes etc.) fragrances and perfumes.

In a preferred approach, the chemicals (or agents) of interest are microencapsulated in microcapsules. Suitable microcapsules are those that melt at a particular initiation temperature. Alternative microcapsules are those that allow diffusion of the active chemicals through their walls to effect a slow release mechanism within the insole. By appropriate temperature control, the heater element in the insole may then be used to initiate the delivery of such active chemicals or agents.

It will be understood that by the encapsulation of various active chemicals and the use of microcapsules having different thermal characteristics, the timing of the delivery of each chemical can be controlled as required. Normally, the microencapsulated components will not form part of the heater element itself. Instead they will typically be contained within other layers of the insole e.g. the face fabric layer. The release of the chemicals is typically achieved using the heater, which is preferably adjacent to the layer containing the microencapsulated components. The breathability of the fabric heater assists the circulation of the released functional chemicals.

When the face fabric used in the construction of the insole is composed of a compatible material such as a compatible polymer (e.g. polyamide, polyester or blends thereof), the heated insole unit may be thermostatic printed (Registered Trade Mark) or dye sublimation printed in order to improve its aesthetic design and appearance for the purpose of personalisation. Ink jet printing can also be used for the same purpose. The high resolution digital imaging printing processes typically do not interfere with the performance of the heater unit.

Before use, the insole may be cut to size to fit a wide variety of shoe sizes and internal profiles. The insole containing the heater element may also be removed from the shoe and washed (by hand or domestic washing machine) using conventional domestic detergents and rinsing methods and then reused if required.

BRIEF DESCRIPTION OF THE DRAWINGS

Below, an embodiment of the invention is described by way of example, with reference to the accompanying drawings, in which.

DETAILED DESCRIPTION OF THE PREFERRED EMBODIMENTS

Figure 1:
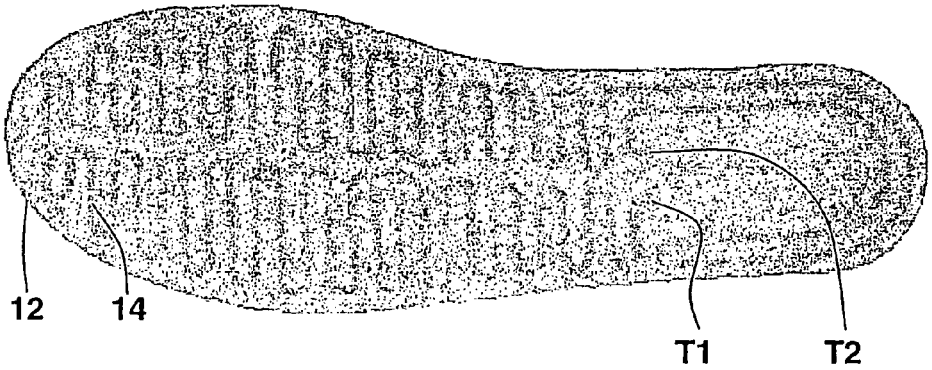
FIG. 1 shows a plan view of a metallised fabric heater element for use in an insole in accordance with an embodiment of the invention.

FIG. 1 shows a plan view of a metallised fabric heater element 12 according to an embodiment of the invention. The heater element is formed by taking a nickel coated polyester woven fabric and cutting it to the shape of an insole, as shown in FIG. 1. This cutting operation may be performed before or after (preferably after) the etching of the track pattern (described below). A suitable material is the commercially available metallised fabric Metalester (Registered Trade Mark), a woven electroless nickel plated polyester mesh. Such fabrics are available with a variety of thread thicknesses, thread spacings, type of weave and weight of nickel. Threads may typically have a diameter within the range 24 to 600 micrometers (microns), a thread count of between 4 and 737 per cm, and a metal coating of varying weight per square meter.

Suitable fabrics may be coated with a continuous layer of metal after manufacture, for example by sputtering, by chemical reduction or by electro-deposition, which results in total encapsulation of all the threads of the mesh in metal. In an alternative mesh, the individual warp and weft threads may be metallised prior to fabric production, for example by sputtering, by chemical reduction or by electro-deposition.

After selecting the desired metallised fabric and cutting it to the required shape, the desired track pattern is then photochemically etched from the fabric. This is done by first designing and generating a suitable phototool, in a way well known to the skilled person. Next, the fabric is mounted onto a hinged frame of brown styrene board, so that the otherwise flimsy fabric can be more readily handled. The fabric is then cleaned with a commercial surface cleaning agent to assist in the adhesion of the photoresist. Then, the photoresist is applied, typically by dip-coating the fabric into a liquid photoresist to ensure application of the photoresist to all parts of the fabric by immersion.

Next, the fabric is exposed to a suitable image pattern of ultraviolet light from the phototool. This image is developed. The unrequired metal is then progressively etched away.

Then, the photoresist is removed to leave the required metallic track shape for the heater element. These steps will be clear to the skilled person. The metallic track is indicated by reference numeral 14 in FIG. 1 and by reference numerals 42, 44 and 48 in FIG. 5 Track 14 is formed in such a shape that termination pads T1 and T2 are formed close to the heel portion of the shape of the heater element. Termination pads are for connection to a battery or control unit for energising the heater element to generate heat. FIG. 1 shows the termination pads T1 and T2 located close to the heel portion of the shape of the heater element. However, as explained below with reference to FIG. 5, the electrical terminals of the track may be formed in another configuration, e.q. by tail portions (shown in FIG. 5) of the track extending from the heel portion. Since the fabric of the heater element is flexible, such tail portions are also flexible, and allow the connection between the conductive track and a battery or control circuit to be made away from the sole of the foot of a person wearing footwear incorporating the embodiment of the invention.

Figure 5:
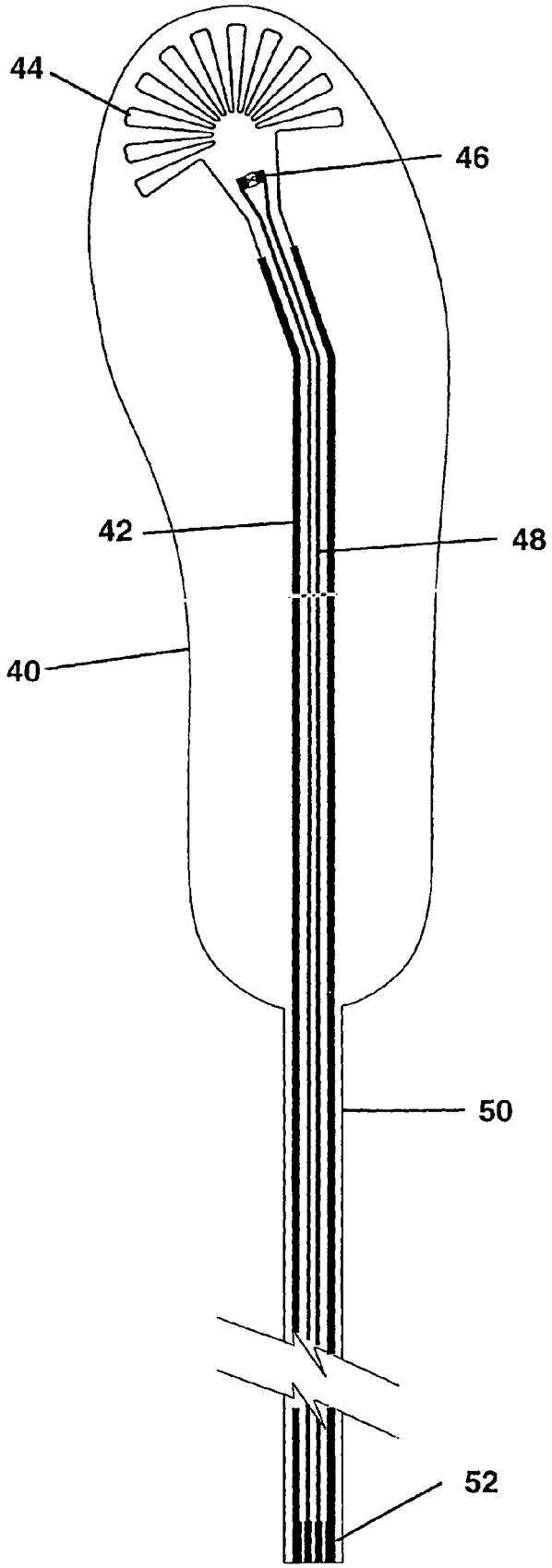
FIG. 5 shows a plan view of a metallised fabric heater element for use in an insole in accordance with an alternative embodiment of the invention.

FIG. 5 shows an alternative embodiment of a heater element. Shaped fabric 40 has a tail portion 50 (as explained above). A conductive heating track 44 is formed preferentially at the toe part of the heater element. This allows, in use, the toe area of the footwear (e.g. ski boot) to be heated more than the remainder of the footwear. A thick track 42 extends along the length of the element and along flexible tail portion 50 to terminal part 52. Also, a thinner track 48 is formed between thicker tracks 42. Track 48 connects a surface mounted thermistor 46 to the terminal part 52.

Figure 2:
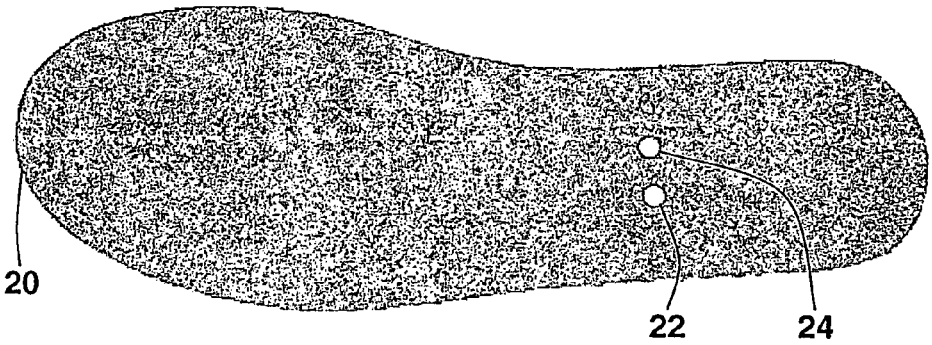
FIG. 2 shows a plan view of an insole component for bonding to the heater element of FIG. 1.

FIG. 2 shows an insole facing material 20. It has the same overall shape as the fabric of the heater element. It also has two holes 22, 24 for allowing connection to be made to the termination pads T1, T2.

Figure 3:
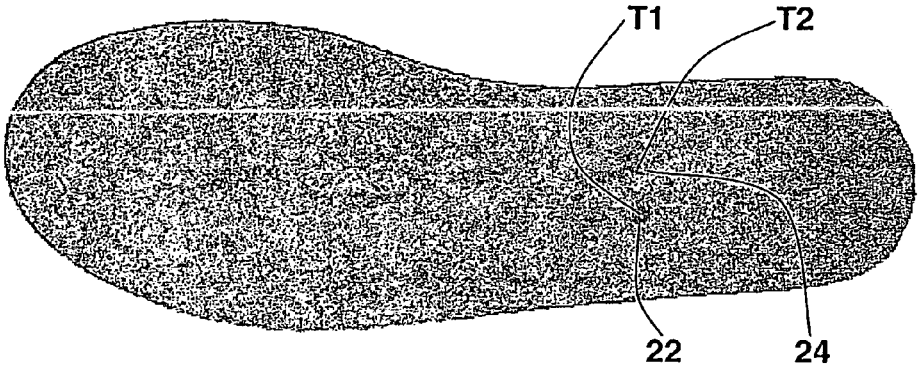
FIG. 3 shows a plan view of a laminated heater insole according to an embodiment of the invention.

Insole insulating material is bonded to both sides of the heater element 12. For example, a thermoplastic web may be used to bond the insole insulation material to both faces of the heater element. The resultant insole heater is shown in FIG. 3. A suitable thermoplastic web material is the melt-spun interlining material Vilene (registered trade mark) U25 supplied by Freudenberg Nonwovens Interlining Division (part of Freudenberg Vliesstoffe KG). The U25 grade is made from 100% polyamide and has a random web structure and a weight of 25 grams per square meter. The material softens and fuses when heat is applied at about 130° C. for about 10 seconds with a pressure of 15-30 N/cm$^2$. The web has a high degree of open porosity and so allows the lamination between the face fabric 20 and the heater element 12,40 to give rise to a breathable structure.

Figure 4:
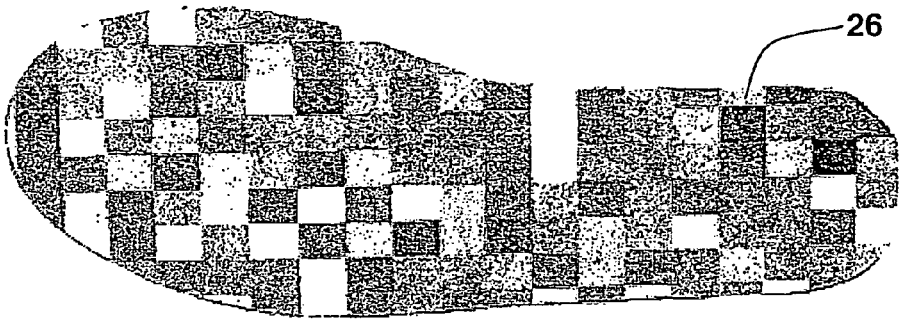
FIG. 4 shows a plan view of a decorated insole according to an embodiment of the invention.

It is possible to decorate the surface of the insole heater as required. For example, the insole heater can be decorated with a digital image 26, as illustrated schematically in FIG. 4 with an example image. This decoration can be applied using known techniques, such as thermostatic printing (Registered Trade Mark).

Appropriate track pattern selection allows the insole heater to be trimmed to fit the footwear into which it will be inserted.

Additional circuit components may be incorporated into the heater element circuit. Of particular interest is a thermistor chip, as shown in FIG. 5, for limiting the temperature of the heater element.

A suitable power supply (not shown) is supplied by Mpower Batteries Limited, consisting of 2×3.6 V lithium ion batteries. Suitable control circuitry is also available from the same source. See also the control circuitry disclosed in WO 03/039417.

The insole facing or backing material 20 can be of the type that is breathable, e.g. microporous breathable material such as fabric or film. In a preferred embodiment, agents (not shown) are incorporated into the insole facing or backing material 20. In a preferred approach such agents are microencapsulated in microcapsules, which melt at a particular initiation temperature or others, which allow diffusion of the active agents through their walls to effect a slow release mechanism within the insole.

The microcapsules used are of the type that release their contents due to heat activation, e.g. due to melting of the capsule wall material or thermal degradation of the capsule wall material or diffusion of the content of the capsule through the wall due to increased temperature. In particular, microcapsules that gradually release their content on heating are preferred.

For insoles, microencapsulated perfumes are of particular interest. Also of interest are microencapsulated antimicrobial compounds and insect repellant compounds. Suitable microencapsulation techniques to allow such compounds to be gradually released on heating are known to the skilled person.

For a specific example of a microencapsulated insect repellent, the microcapsules of US-A-20030124167 are incorporated into the face fabric of the insole.

Suitable materials for encapsulating suitable agents include lipids such as wax, paraffin, tristearin, stearic acid, monoglycerides, diglycerides, beeswax, oils, fats and hardened oils.

Suitable perfumes and fragrances are known. These may be encapsulated in wax, for example.

Microencapsulated fragrances are available from Celessence International, of Hatch End, Pinner, Middlesex, HA5 4AB, UK.

Suitable fragrances are disclosed in U.S. Pat. No. 6,290,977. For example, the desired fragrance may be any one or more of those which are commonly used by those skilled in the art of toiletry fragrance chemistry or perfumery, some of which are listed in the following texts: Robert R. Calkin, J. Stephan Jellinek, Perfumery, Practice and Principle, John Wiley and Sons, Inc., New York, 1994; Rudiger Hall, Dieter Klemme, Jurgen Nienhaus, Guide to Fragrance Ingredients, H&R Edition, R. Gross & Co. Publishing, Hamburg, 1985; Julia Muller, The H&R Book of Perfume, H&R Edition, Johnson Publications, Ltd., London, 1984; Fragrance Guide-Feminine Notes, Masculine Notes, H&R Edition, R. Gross & Co. Publishing, Hamburg, 1985 which are incorporated by reference herein.

The embodiments above have been described by way of example. Modifications of these embodiments, further embodiments and modifications thereof will be apparent to the skilled person on reading this disclosure and as such are within the scope of the invention.

The invention claimed is:

1. A breathable insole heater element for footwear, comprising:

a flexible metallised substrate of porous fabric having a plurality of components each encapsulated with metal wherein the metal on the metallised substrate of fabric is photochemically etched to form the breathable insole heater element by selectively etching out metal encapsulated about the plurality of components of the substrate of porous metallised fabric;

a layer of insole face fabric;

a backing layer; the flexible metallised substrate being laminated between the layer of insole face fabric and the backing layer; the face fabric being attached to the flexible metallised substrate by a thermoplastic web;

whereby the flexible metallised substrate is configured to provide an insole heater element that is porous and breathable.

2. An insole heater element according to claim 1 wherein the pattern of the heater element is selected so that a first part of the heater element provides a different heat output in use to that of a second part of the heater element.

3. An insole heater element according to claim 1 having a thermal protection device to provide temperature control of the heater element.

4. An insole heater element according to claim 3 wherein the thermal protection device is a surface mounted thermistor.

5. An insole heater element according to claim 1 wherein the metallised fabric is coated with a continuous layer of metal.

6. An insole heater element according to claim 1 wherein the components of the substrate of porous metallised fabric are individual yarns, the individual yarns being encapsulated in metal prior to manufacture of the substrate of porous metallised fabric.

7. An insole heater element according to claim 1 wherein the fabric is selected from the group consisting of woven, non-woven, knitted, laminated composite, pressed felt, and braid fabrics.

8. An insole heater element according to claim 1 wherein the components of the substrate of porous metallised fabric are woven polyester threads and the metal is nickel.

9. An insole heater element according to claim 1, further comprising:

termination pads for connection of the heater element to a power supply/control system.

10. An insole heater element according to claim 1, further comprising:

a flexible fabric connection member for protruding from the final insole so as to provide connection of the heater element to a power supply/control system.

11. An insole heater element according to claim 1 wherein the flexible metallised substrate is formed integrally with a component of the insole heater element.

12. An insole heater element according to claim 1 wherein the flexible metallised substrate extends substantially the full length of the insole heater element.

13. An insole heater element according to claim 1 wherein the flexible metallised substrate is configured so that the insole heater element can be cut or trimmed to one of several possible shapes or sizes to fit an article of footwear without adversely affecting the operation of the insole heater element.

14. An insole heater element according to claim 1 having heat-activatable agents for release due to heat generated by the insole heater element.

15. An insole heater element according to claim 14 wherein the agents are selected from antimicrobials, insect repellents, fragrances, perfumes.

16. An insole heater element according to claim 14 wherein the agents are microencapsulated in microcapsules.

17. An insole heater element according to claim 16 wherein the microcapsules melt at an initiation temperature.

18. An insole heater element according to claim 16 wherein the microcapsules allow diffusion of the agent through their walls to effect a slow release mechanism within the insole heater element at an initiation temperature.

19. The insole heater element according to claim 1 wherein the components of the substrate of porous metallised fabric are individual fibres, the individual fibres being encapsulated in metal prior to the manufacture of the substrate of porous metallised fabric.

20. The insole heater element according to claim 1 wherein the components of the substrate of porous metallised fabric are individual yarns, the individual yarns being encapsulated in metal after manufacture of a substrate of a porous fabric to form the substrate of porous metallised fabric.

21. The insole heater element according to claim 1 wherein the components of the substrate of porous metallised fabric are individual fibres, the individual fibres being encapsulated in metal after manufacture of a substrate of a porous fabric to form the substrate of porous metallised fabric.

* * * * *